US005244316A

United States Patent [19]

Wright et al.

[11] Patent Number: 5,244,316

[45] Date of Patent: Sep. 14, 1993

[54] BORER-RESISTANT WATERFRONT RETAINING BULKHEAD

[76] Inventors: William M. Wright, P.O. Box 145, Warsaw, Va. 22572; Donald E. Andrews, 1710 Garden of Eden, Cambridge, Md. 21613

[21] Appl. No.: 958,483

[22] Filed: Oct. 8, 1992

Related U.S. Application Data

[63] Continuation of Ser. No. 768,346, Sep. 30, 1991, abandoned, which is a continuation of Ser. No. 702,780, May 17, 1991, abandoned.

[51] Int. Cl.[5] ..... E02D 29/02

[52] U.S. Cl. ..... 405/285; 405/262; 405/274; 405/284

[58] Field of Search ..... 403/258, 262, 272, 273, 403/274, 284, 285, 286; 256/19, 24, 59

[56] References Cited

U.S. PATENT DOCUMENTS

| | | | |
|---|---|---|---|
| 293,223 | 2/1884 | Brown | 29/700 |
| 370,108 | 9/1887 | Wakefield | 405/274 |
| 1,483,825 | 2/1924 | Martinez | 405/274 |
| 1,679,319 | 7/1928 | Marshall | 405/274 |
| 1,902,397 | 3/1933 | Doyle | 405/274 |
| 1,907,135 | 5/1933 | Wemlinger et al. | 405/285 |
| 2,879,647 | 3/1959 | Hayden | 405/285 |
| 4,471,947 | 9/1984 | Osborne | 256/24 |
| 4,674,921 | 6/1987 | Berger | 405/262 |
| 4,728,225 | 3/1988 | Brandl et al. | 405/262 |
| 4,790,690 | 12/1988 | Vidal et al. | 405/262 |
| 4,899,991 | 2/1990 | Brunkan | 256/24 X |
| 4,917,543 | 4/1990 | Cole et al. | 405/262 |

FOREIGN PATENT DOCUMENTS

| | | | |
|---|---|---|---|
| 70926 | 2/1926 | Austria | 405/285 |
| 202626 | 10/1908 | Fed. Rep. of Germany | 405/284 |
| 55908 | 3/1984 | Japan | 405/284 |

*Primary Examiner*—Dennis L. Taylor
*Assistant Examiner*—John Ricci
*Attorney, Agent, or Firm*—Kilpatrick & Cody

[57] ABSTRACT

Borer-resistant waterfront retaining bulkheads. Such bulkheads feature a wall of sheeting placed seaward of the piles, rather than landward, as in conventional structures. Alternatively, the bulkheads may employ no piles but rather be supported by anchors. These structures improve water current flow over the bulkheads and thus help eliminate marine borers which typically attack the sheeting. A number of upper and lower wales hold the sheeting in place with respect to piles with no appreciable loss in overall strength or durability of the structure. The sheeting may be formed in two or more layers of boards, some of which may be tongue-and-grooved and/or shiplapped. Outer layers of boards in the sheeting, which bear heavier exposure to wind, water and waves, may be formed of sapwood or other materials for maximum strength and durability at minimum expense. Some or all of the wales may be formed of laminated sapwood to lend additional strength and durability. Such arrangement of components allows the builder to maximize strength and durability and minimize expense by selecting the materials and treatment types for each layer of boards in the sheeting, and each wale that is used, depending upon environmental factors and cost considerations.

41 Claims, 3 Drawing Sheets

BORER-RESISTANT WATERFRONT RETAINING BULKHEAD

This is a continuation of copending application Ser. No. 07/768,346 filed on Sep. 30, 1991, now abandoned; which is a continuation of Ser. No. 07/702,780 filed on May 17, 1991, now abandoned.

The present invention relates to waterfront bulkheads with improved resistance to marine borers.

BACKGROUND OF THE INVENTION

Earth and water-retaining structures and bulkheads at beaches and shorelines take various forms. Incessant exposure to tides and waves in a beachfront environment usually requires cement or rock structures, including riprap, sea walls and revetment. Along the shores of bays, intercostal waterways, rivers and lakes, however, wooden bulkheads provide durable protection that is less expensive and easier to install.

One primary problem associated with wooden waterfront retaining bulkheads is that they are subject to marine borers. Such borers can, within a few years, penetrate, severely weaken and destroy bulkhead structures. The damage they impart can be insidious, because the structural integrity occasioned by massive infestation of borers may be imperceptible from the appearance of only a few holes on the surface of the structure. Such borers include mollusks such as the shipworm or teredo, a bivalve which rasps and digests wood particles for protection and nutrition, clams such as the martesia or wood piddock which can penetrate an inch or more into wood, and crustaceans such as gribbles or limnoria, sphaeroma, and chelara, whose horny jaws are particularly well adapted for boring into wood and forming interlacing burrows that can devastate structural integrity.

SUMMARY OF THE INVENTION

It has been found that currents as low as 1½ knots on the surface of a bulkhead can reduce the propensity of marine borers to propagate on and in the bulkhead, probably since eggs and larvae are washed away. It is also common knowledge that wood treatment compositions and processes, including the use of copper compositions such chromated copper arsenate, creosote and pentachlorophenol, increase resistance of wood to marine borers.

The present invention employs optimum selection and placement of treated wood structural members that take advantage of these two principles to provide bulkheads that exhibit increased resistance to marine borers and to the elements.

Bulkheads of the present invention feature a wall of sheeting located on the seaward side of the bulkhead piles, unlike conventional wooden bulkheads, in which the sheeting is placed on the landward side of the piles in order to transmit earth-imposed forces against the piles. It has been found that placing the sheeting on the seaward side of the piles causes no substantial loss in bulkhead strength and durability, and it presents a flat surface to the water in order to take advantage of the water current's removal of borers, eggs and larvae. In fact, the smooth surface presented by the bulkhead to the water reduces hydrodynamic forces which cause wear and tear.

Alternatively, no piles at all may be used, and the sheeting may be supported and stabilized via one or more anchors placed in the fill on the landward side of the bulkhead, and connected to the upper or lower wales with tension members such as tierods. Where the anchor is connected to the upper wale, no lower wales are necessary for many applications.

The seaward disposition of the wall or sheeting, which is uninterrupted by piles, also allows the opportunity to place a layer of boards on the outer face of the sheeting, which boards are suffused with borer-resistant material such as, for instance, sapwood treated with copper compositions such as chromated copper arsenate (CCA). Wales which retain the sheeting in place against the piles may also be formed of such borer-resistant treated materials. Such designs thus allow maximum benefit from the marine borer-resistant substances used to treat portions of the bulkhead.

Bulkheads according to the present invention are also maintained far easier than conventional bulkheads. The process of deterioration in timber bulkheads usually happens first in the sheeting, then in the wales, and then in the piles. Bulkheads according to the present invention make require only that the wales be unbolted and new sheeting be added for the most typical maintenance. In conventional bulkheads, by contrast, the wales are located on the inside (landward) of the piles and cannot be easily removed.

In a preferred embodiment of the present invention, for instance, the sheeting which faces the water contains an outer layer formed of a number of treated sapwood shiplapped southern pine barrier boards. A layer of tongue and grooved boards, together with, if desired, one or more intermediate layers of tongue and grooved or shiplapped boards, lends strength to the sheeting. The barrier boards, intermediate boards and planks may be overlapped with respect with one another to lend water tightness to the structure. Upper and lower wales retain the sheeting in place against the piles, and advantageously, the lower wales, or outer wales, which are exposed to the water more frequently than the upper or inner wales, may be formed of laminated, treated sapwood. Strategic placement of treated sapwood lends maximum strength and durability to wall at minimum expense.

It is accordingly an object of the present invention to provide new borer-resistant waterfront retaining bulkheads which maximize benefits of marine borer resistant wood or other materials at minimum expense in order to provide a durable and strong structure.

It is another object of the present invention to provide borer-resistant waterfront retaining bulkheads which utilize sheeting placed on the seaward side of piles, or employ no piles, in order to improve the marine borer resistance characteristics lent by treatment of bulkhead materials with borer-resistant substances.

It is another object of the present invention to provide borer-resistant waterfront retaining bulkheads which may take a variety of forms, depending upon the severity of environment imposed by wind, water and waves, to exhibit maximum resistance to marine borers, at minimal expense.

Other objects, features and advantages of the present invention will become apparent with reference to the remainder of this document.

DETAILED DESCRIPTION OF THE DRAWINGS

Figure 1:
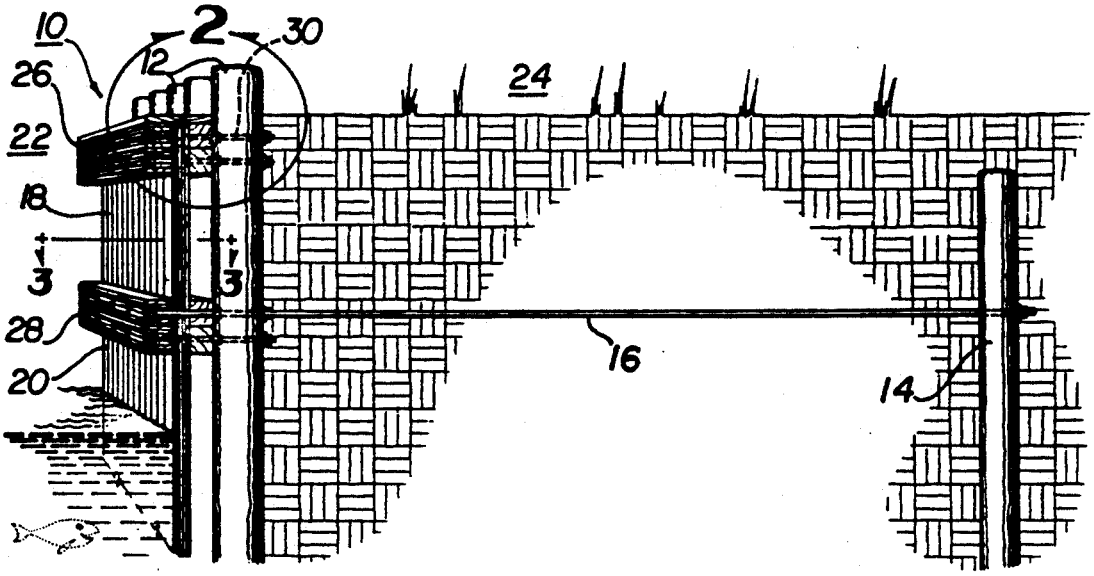
FIG. 1 is a cross-sectional view of a preferred embodiment of a bulkhead according to the present invention in place.

FIG. 1 shows generally a borer-resistant waterfront retaining bulkhead according to a preferred embodiment of the present invention in place, in cross-section. Bulkhead 10, as in conventional bulkheads, includes a series of piles 12 which are driven into the earth at points where earth and water retaining structure is required. One or more anchors 14 may be placed in the earth on the landward side of bulkhead 10 and connected to piles 12 or other portions of the bulkhead 10 as desired, via tension members 16, as is conventional. Tension members may be metallic tie rods, and preferably connect an anchor 14 to a pile 12. Other configurations may also be utilized.

Bulkhead 10 features a wall 18 formed of sheeting 20 located on the seaward side 22 of the series of piles 12, rather than the landward side 24, as is conventional. Conventionally, wall 18 is placed behind (landward of) piles 12 so that the earth forces wall 18 against piles 12 which absorb those forces and transmit them to the earth. It has been found, however, that a bulkhead 10 with wall 18 properly connected to piles 12 on the seaward side 2 exhibits appropriate strength and durability characteristics.

In the preferred embodiment of the bulkhead 10, upper wales 26 and lower wales 28 hold sheeting 20 in place with respect to piles 12. Upper wales 26 comprise landward upper wales 26B and seaward upper wales 26A between which sheeting 20 is disposed. Similarly, lower wales 28 comprise landward lower wales 28B and seaward lower wales 28A. Each wale is preferably formed of six-inch by six-inch treated pine. Any of the wales, including seaward wales, lower wales 28, and particularly seaward lower wales 28A, may be formed of laminated sapwood or other materials as desired, and preferably laminations of two-inch by six-inch laminated board.

The wales are placed so that the landward wales 26B and 28B are adjacent to the piles 12 and extend from pile 12 to pile 12 in the series of piles 12. The seaward wales 26A and 28A are placed substantially parallel to landward wales 26B and 28B, and at substantially the same height so that sheeting 20 is disposed between the landward and seaward wales. In this fashion, the wales serve to retain sheeting 20 in place with respect to piles 12. Fasteners 30, such as ¾" bolts with appropriate washers, may be used to connect the wales, sheeting 20 and piles 12.

Figure 2:
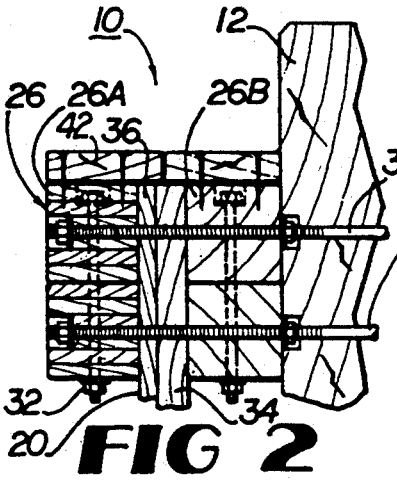
FIG. 2 is a cross-sectional view of the upper wale portion of the bulkhead of FIG. 1.

Each set of wales, as shown more clearly in FIG. 2, may comprise two or more wales disposed adjacent to one another and connected via bolts 32 or other appropriate fastener. In constructions using laminated wales, bolts 32 also serve to hold laminations in place with respect to one another. The wales are preferably, but not necessarily, countersunk for a finished appearance.

Figure 6:
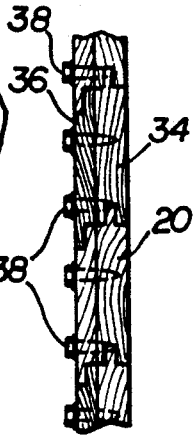
FIG. 6 is a top plan view of sheeting according to another embodiment of the present invention in which the barrier boards and planks are aligned.
Figure 3:
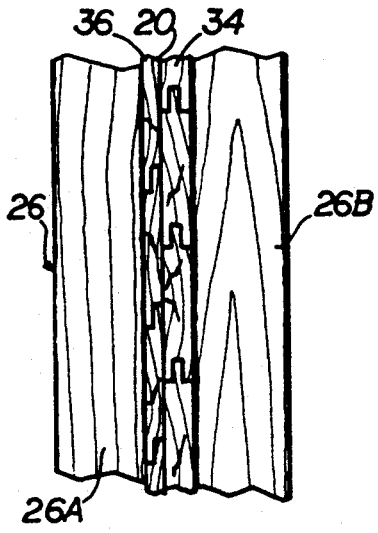
FIG. 3 is a top cross-sectional view of portions of the bulkhead of FIG. 1.
Figure 7:
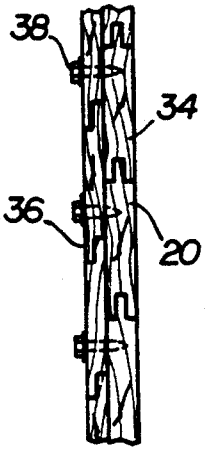
FIG. 7 is a top plan view of sheeting according to another embodiment of the present invention in which the barrierboards and planks overlap.

Sheeting 20 includes a layer of planks disposed against landward wales 26B and 28B, and a layer of barrier boards 36 disposed on the seaward side of planks 34. Barrier boards 36 may be substantially aligned with planks 34 as shown in FIG. 6, or overlap them as shown in FIGS. 3 and 7. Barrier boards 36 may be fastened to planks 34 using fasteners 38 such as lag screws, bolts, or pins. Planks 34 are preferably tongue-and-groove pine lumber, and barrier boards 36 are preferably shiplapped pine lumber, although planks 34 may also be shiplapped, flat edge or otherwise dressed as appropriate, and barrier boards 36 may be tongue and groove, flat edge or otherwise dressed. Overlapping of barrier boards 36 and planks 34 provides a tortuous path for penetration of sheeting 20, and thus helps make sheeting 20 more impervious to leakage of backfill. Barrier boards 36 may be connected to planks 34 as shown, for instance, in FIGS. 6 and 7, in order to allow a board 36-plank 34 combination to be driven into the earth in one operation, and thus reduce labor costs. Lag screws, bolts, pins, nails or other fasteners 38 may be used as desired for this purpose.

Figure 4:
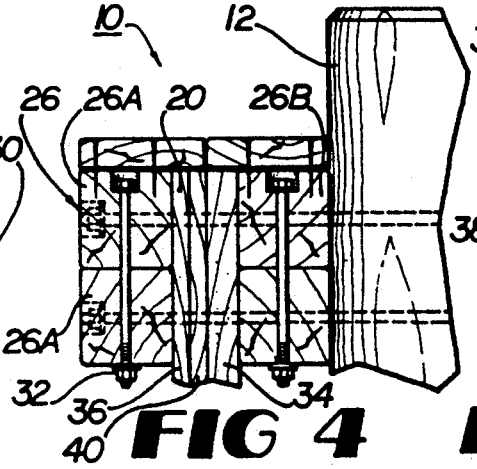
FIG. 4 is a cross-sectional view of wale portions of a second embodiment of a bulkhead according to the present invention having an intermediate layer of boards in the sheeting.
Figure 5:
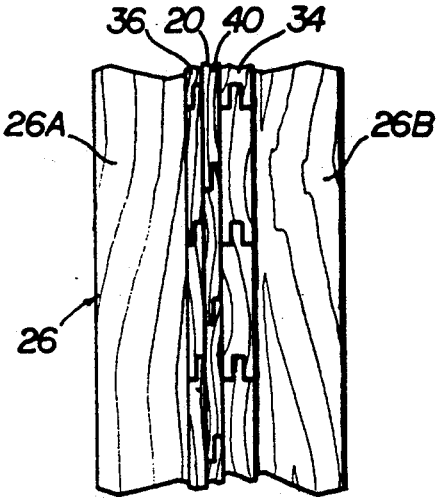
FIG. 5 is a top cross-sectional view of portions of the bulkhead of FIG. 4.

One or more intermediate layers of boards 40 may also be placed in sheeting 20 between barrier boards 36 and planks 34, as shown in FIGS. 4 and 5. Such intermediate boards 40 may be shiplapped, tongue and groove, flat edge or otherwise dressed as desired. As in the two-layer sheeting 20 described above, a barrier board 36, intermediate board 40 and plank 34 may be secured together to form a single unit for ease of installation and additional strength and integrity.

Barrier boards 36, intermediate boards 40 and/or planks 34 may be formed of material other than lumber, such as, for instance, plastic material, as may be desired, and depending on cost considerations. Cap boards 42 may be placed on top of upper wales 26 to cover them and sheeting 20 and secured with nails. The cap boards are preferably two-inch by eight-inch boards.

In the preferred embodiment, piles 12 are ten-inch minimum butt, 20-foot minimum length timber piles, and anchor 14 are eight-inch minimum butt, 10-foot minimum length timber piles. Other sizes may be used. Non-laminated wales are preferably six-inch by six-inch pine, and laminated wales are preferably formed of one or two-inch by six-inch pine sapwood boards as shown in FIGS. 1 and 2. Planks 34 are preferably two-inch by ten-inch by twelve foot tongue-and-groove pine boards, while barrier boards 36 ar preferably one-inch by eight-inch by eight-foot pine sapwood boards. Again, other sizes of any members discussed herein may be used. Intermediate boards 40 may be sapwood or non-sapwood as desired, and may be shiplapped, tongue-and-grooved, flat edge or otherwise dressed.

Appropriate materials for salt water environments include southern pine, ponderosa pine, red (Norway) pine, coastal douglas fir, western hemlock, eastern (northern) white pine, redwood, jack pine, lodgepole pine, sugar pine, western (Idaho) white pine, oak, black gum, red gum, yellow poplar and plywood. Oaks and gums are frequently found more difficult to treat adequately with many types of preservatives. Appropriate materials for fresh water use include the above plus interior douglas fir, radiata pine, and caribbean pine.

For maximum borer resistance and durability, all wooden components are preferably treated with marine-borer resistant materials such as those prescribed in the American Wood Preservers' Association (AWPA) standards, which are incorporated herein by this reference. Typical treatments include the use of copper compositions such as chromated copper arsenate (CCA), acid copper chromate (ACC), ammoniacal copper arseate (ACA), ammoniacal copper zinc arsenate (ACZA), and alkyl ammonium compound (AAC). Creosote treatment may be desirable, particularly where pholads are expected to be encountered. Standards for treatment of the materials of bulkheads of the present invention may be found in the AWPA Standard P5, "Standards For Waterborne Preservatives," Standard C18, "Standard For Pressure Treated Material In Marine Construction," C1, "All Timber Products—Preservative Treatment By Pressure Processes," and C2, "Lumber, Timbers, Bridge Ties and Mine Ties—Preservative Treatment By Pressure Processes," which are incorporated herein by this reference.

Preferably, wales, barrier boards 36, intermediate layers 40 and planks 34, which face maximum water exposure, are 2.5 pound CCA Type C treated, while piles 12 and anchors 14 may be 1.5 pound CCA Type C treated. Cap boards 42, which serve to finish bulkhead 10, may be 0.6 pound CCA Type C treated. All hardware should be stainless steel or hot dip galvanized in the preferred embodiment.

Figure 8:
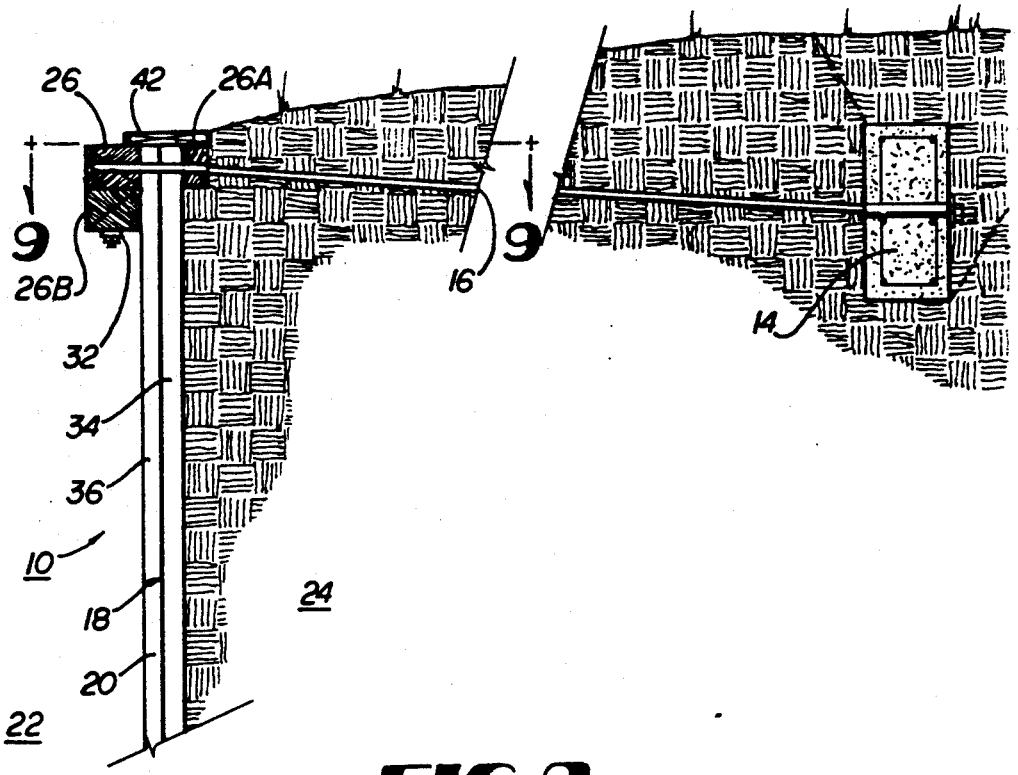
FIG. 8 is a side cross sectional view of another embodiment of a bulkhead of the present invention which employs no piles, and in which the anchor is connected to an upper, seaward wale.
Figure 9:
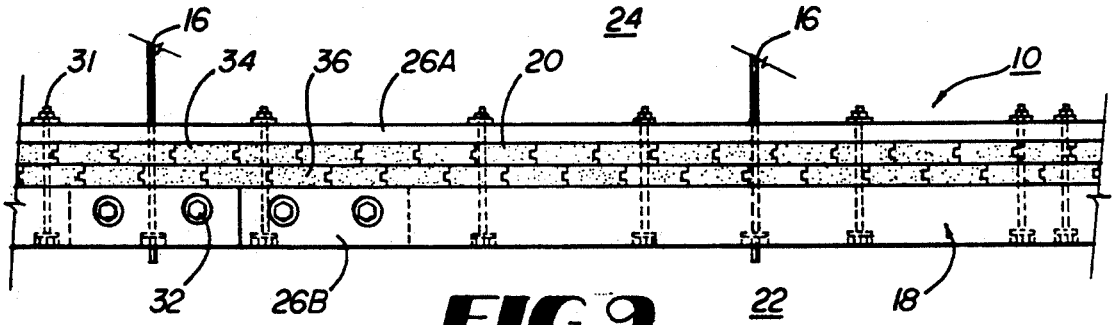
FIG. 9 is a top cross sectional view of sheeting of the bulkhead of FIG. 8.
Figure 10:
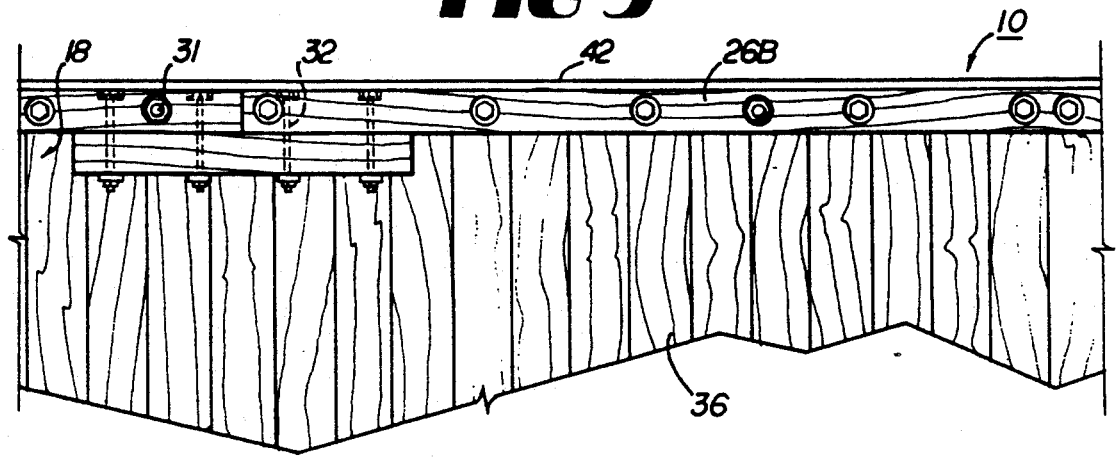
FIG. 10 is a front elevational view of the bulkhead of FIG. 8.
Figure 11:
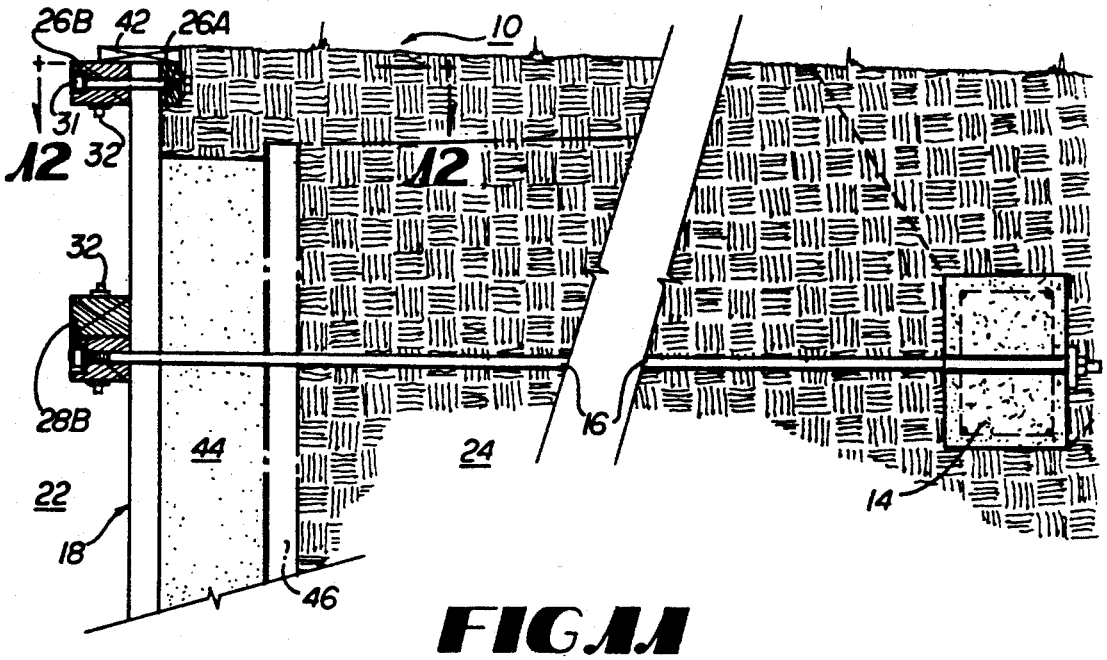
FIG. 11 is a side cross sectional view of another embodiment of a bulkhead of the present invention which employs no piles, and in which the anchor is connected to a lower, seaward wale.
Figure 12:
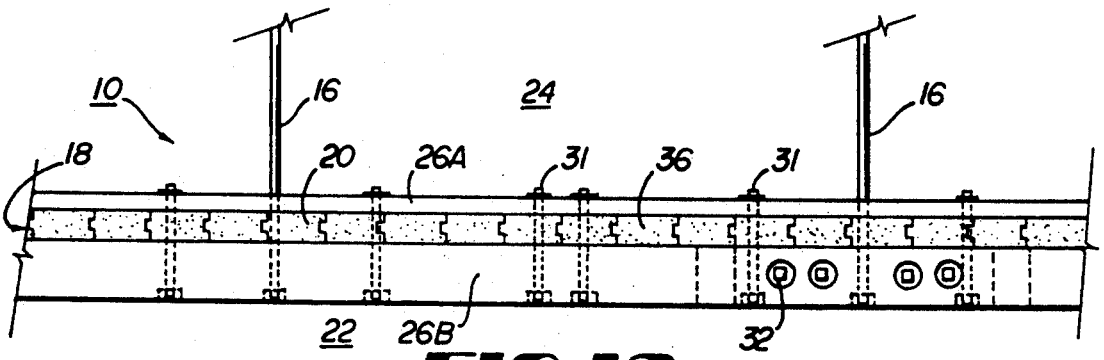
FIG. 12 is a top cross sectional view of sheeting of the bulkhead of FIG. 11.
Figure 13:
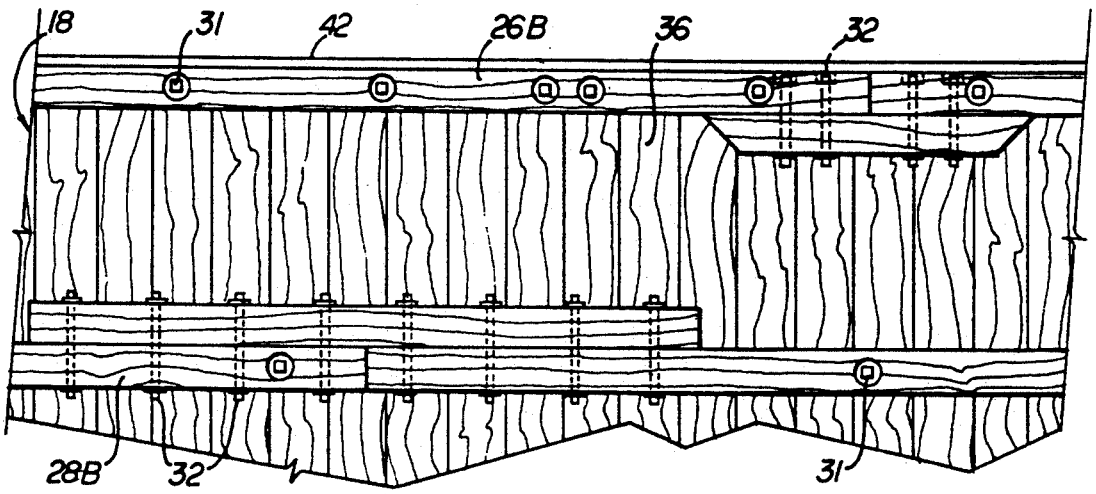
FIG. 13 is a front elevational view of the bulkhead of FIG. 11.

FIGS. 8–13 show embodiments of bulkheads of the present invention which employ no piles, but instead use anchors 14 in combination with tension members 16 to stabilize and to support walls 18. FIGS. 8–10 show such a bulkhead 10 in which the tension members 16 are connected to upper wales 26. In that embodiment, no lower wales 28 need be used. FIGS. 11–13 show such bulkheads 10 in which the tension members 16 are connected to lower wales 28; in that embodiment, only a seaward lower wale 28B need be used, in combination with an upper wale 26 formed of seaward upper wale 26 formed of seaward upper wale 26B and landward upper wale 26A, which may be less substantial in structure than the upper wale 26 shown in the version where no lower wale 28 is used. The wall 10 may be formed using barrier boards 36 planks 34 and/or intermediate layers 40 (not shown) as desired. The wall 10 may be supported by a retainer structure 44, as shown in FIG. 11, which may include an additional wall or other members 46 placed in the fill on the landward side of wall 10, the void between wall 10 and members 46 being filled with concrete, gravel, earth, or as otherwise desired.

Anchor 14 in this embodiment may take on a more substantial form than anchors 14 used with bulkheads that employ piles. Anchors 14 in the pileless structures may be formed, for instance, of concrete members.

Upper wales 26 serve to bind the boards and planks 34, 36, and/or 40; for this purpose, binding fasteners 31 connect seaward upper wales 26B and landward upper wales 26A.

Lowers wales 28 may be used in embodiments as shown in FIGS. 8–10 where upper wales 26 are connected to tension members 16. Additionally inner lower wales 28A may also be used if desired. Piles 12 (not shown) may be interspersed if desired for additional stabilization and fastened to wall 18 using fasteners 30 (not shown) as discussed above.

The above description is provided for purposes of explanation and illustration of preferred embodiments of the present invention. Modifications and alterations may be made without departing from t he scope and spirit of the invention.

What is claimed is:

1. A borer-resistant waterfront retaining bulkhead, comprising:

(a) a series of piles placed substantially vertically into the earth, and having a landward and a seaward side;

(b) at least one inner upper wale extending between a plurality of the piles on the seaward side of the series of piles only;

(c) at least one inner lower wale extending between a plurality of the piles on the seaward side of the series of piles only;

(d) sheeting placed adjacent to the inner wales on the seaward side of the piles only, and comprising:

(i) a plurality of planks placed substantially vertically into the earth and adjacent to the inner wales so that portions of the plank edges overlap; and (ii) a plurality of sapwood barrier boards treated with borer-resistant substance placed substantially vertically into the earth and substantially parallel to the planks so that portions of the barrier board edges overlap to form the seaward side of the sheeting;

(e) at least one seaward upper wale placed adjacent to the sheeting on the seaward side of the sheeting and extending substantially parallel to and at substantially the same height as the inner upper wale;

(f) at least one seaward lower wale placed adjacent to the sheeting on the seaward side of the sheeting and extending substantially parallel to and at substantially the same height as the inner lower wale; and (g) a plurality of fasteners connecting the seaward upper and lower wales in place with respect to the piles in order to assist in retaining the sheeting in place between the inner and seaward wales;

thus forming a bulkhead adapted for enhanced resistance to marine borers by virtue of the piles being located on the landward side of the sheeting only, and the seaward side of the sheeting being of treated sapwood barrier boards that are resistant to marine borers by reason of the boards being relatively thin sapwood which is easily penetrated by borer-resistant substances, and containing little, if any, heartwood which is more resistant to penetration by borer-resistant substances and therefore offers less resistance to borer penetration.

2. The bulkhead of claim 1 further comprising a plurality of capboards placed on top of the upper wales.

3. The bulkhead of claim 1 further comprising a plurality of anchors placed in the earth on the landward side of the series of piles, each anchor connected to at least one of the piles with a tension member.

4. The bulkhead of claim 1 in which the planks comprise tongue and groove boards.

5. The bulkhead of claim 1 in which the barrier boards comprise shiplapped boards.

6. The bulkhead of claim 1 in which at least one wale is formed of laminated sapwood.

7. The bulkhead of claim 1 in which the seaward wales are formed of laminated treated sapwood.

8. The bulkhead of claim 1 further comprising a plurality of fasteners connecting the barrier boards to the planks.

9. The bulkhead of claim 8 in which the fasteners connecting the barrier boards to the planks are selected from a group consisting of lag screws, bolts, and pins.

10. The bulkhead of claim 1 in which the barrier boards overlap the planks.

11. The bulkhead of claim 1 in which the sheeting further comprises a layer of intermediate boards placed substantially vertically into the earth and between the planks and the barrier boards.

12. The bulkhead of claim 11 in which portions of the edges of the intermediate boards overlap.

13. The bulkhead of claim 1 in which the fasteners connecting the seaward wales and the piles are bolts.

14. A borer-resistant waterfront retaining bulkhead, comprising:

(a) a series of piles placed substantially vertically into the earth, and having a landward and a seaward side;

(b) at least one inner upper wale extending between a plurality of the piles on the seaward side of the series of piles only;

(c) at least one inner lower wale extending between a plurality of the piles on the seaward side of the series of piles only;

(d) sheeting placed adjacent to the inner wales, and comprising:

(i) a plurality of tongue and groove planks placed substantially vertically into the earth and adjacent to the inner wales so that portions of the plank edges overlap; and (ii) a plurality of treated, sapwood shiplapped wooden barrier boards treated with borer-resistant substance placed substantially vertically into the earth and substantially parallel to the planks so that portions of the barrier board edges overlap to form the seaward side of the sheeting;

(e) at least one seaward upper wale placed adjacent to the sheeting on the seaward side of the sheeting and extending substantially parallel to and at substantially the same height as the inner upper wale;

(f) at least one seaward lower wale formed of laminated sapwood placed adjacent to the sheeting on the seaward side of the sheeting and extending substantially parallel to and at substantially the same height as the inner lower wale;

(g) a plurality of bolts connecting the seaward upper and lower wales in place with respect to the piles in order to assist in retaining the sheeting in place between the inner and seaward wales;

thus forming a bulkhead adapted for enhanced resistance to marine borers by virtue of the piles being located on the landward side of the sheeting only, and the seaward side of the sheeting being of treated wooden boards that are resistant to marine borers by reason of the boards being relatively thin sapwood which is easily penetrated by borer-resistant substances, and containing little, if any, heartwood which is more resistant to penetration by borer-resistant substances and therefore offers less resistance to borer penetration.

15. The bulkhead of claim 14 further comprising a plurality of capboards placed on top of the upper wales.

16. The bulkhead of claim 14 further comprising a plurality of anchors placed in the earth on the landward side of the series of piles, each anchor connected to at least one of the piles with a tension member.

17. The bulkhead of claim 14 further comprising a plurality of fasteners connecting the barrier boards to the planks.

18. The bulkhead of claim 17 in which the fasteners connecting the barrier boards to the planks are selected from a group consisting of lag screws, bolts, and pins.

19. The bulkhead of claim 14 in which the barrier boards overlap the planks.

20. The bulkhead of claim 14 in which the sheeting further comprises a layer of intermediate boards placed substantially vertically into the earth and between the planks and the barrier boards.

21. A borer-resistant waterfront retaining bulkhead, comprising:

(a) a series of piles placed substantially vertically into the earth, and having a landward and a seaward side;

(b) at least one inner upper wale extending between a plurality of the piles on the seaward side of the series of piles only;

(c) at least one inner lower wale extending between a plurality of the piles on the seaward side of the series of piles only;

(d) sheeting placed adjacent to the inner wales, and comprising:

(i) a plurality of planks placed substantially vertically into the earth and adjacent to the inner wales so that portions of the plank edges overlap;

(ii) a plurality of borer-resistant barrier boards placed substantially vertically into the earth and substantially parallel to the planks so that portions of the barrier board edges overlap to form the seaward side of the sheeting; and (iii) at least one layer of intermediate boards placed substantially vertically into the earth and between the planks and barrier boards;

(e) at least one seaward upper wale placed adjacent to the sheeting and extending substantially parallel to and at substantially the same height as the inner upper wale;

(f) at least one borer resistant seaward lower wale placed adjacent to the sheeting on the seaward side of the sheeting and extending substantially parallel to and at substantially the same height as the inner lower wale; and (g) a plurality of fasteners connecting the seaward upper and lower wales in place with respect to the piles in order to assist in retaining the sheeting in place between the inner and seaward wales;

thus forming a bulkhead adapted for enhanced resistance to marine borers by virtue of the piles being located on the landward side of the sheeting only, and the seaward side of the sheeting being of boards that are resistant to marine borers.

22. The bulkhead of claim 21 in which the planks are formed of tongue and groove boards, the carrier boards are formed of shiplapped boards, and the intermediate boards are formed of material selected from the group consisting of shiplapped boards and tongue and groove boards.

23. The bulkhead of claim 21 in which the sheeting includes two layers of intermediate boards.

24. The bulkhead of claim 21 in which the planks overlap the adjacent layer of intermediate boards, and the barrier boards overlap the adjacent layer of intermediate boards.

25. The bulkhead of claim 21 further comprising a plurality of capboards placed on top of the upper wales.

26. The bulkhead of claim 21 further comprising a plurality of anchors placed in the earth on the landward side of the series of piles, each anchor connected to at least one of the piles with a tension member.

27. The bulkhead of claim 21 in which the barrier boards are formed of material selected from the group consisting of sapwood, treated sapwood, treated plywood and plastic.

28. The bulkhead of claim 21 further comprising a plurality of fasteners connecting the barrier boards to the planks.

29. The bulkhead of claim 28 in which the fasteners connecting the barrier boards to the planks are selected from a group consisting of lag screws, bolts, and pins.

30. A borer-resistant waterfront retaining bulkhead without piles, comprising:

(a) a wall of sheeting, comprising:

(i) a plurality of planks placed substantially vertically into the earth so that portions of the plank edges overlap; and (ii) a plurality of borer resistant barrier boards placed substantially vertically into the earth and substantially parallel to the planks so that portions of the barrier board edges overlap to form the seaward side of the sheeting;

(b) only one inner upper wale placed adjacent to the sheeting and extending substantially horiziontally along the landward side of the sheeting;

(c) only one seaward upper wale placed adjacent to the sheeting and extending substantially; parallel to and at substantially the same height as the inner upper wale;

(d) at least one anchor placed on the landward side of the sheeting;

(e) at least one tension member connecting the anchor and the seaward upper wale; and thus forming a bulkhead adapted to enhanced resistance to marine borers by virtue of the seaward side of the sheeting being of boards that are resistant to marine borers.

31. The bulkhead of claim 30 in which the barrier boards are formed of material selected from the group consisting of sapwood, treated sapwood, treated plywood and plastic.

32. The bulkhead of claim 30 in which at least one wale is formed of laminated treated sapwood.

33. The bulkhead of claim 30 in which the barrier boards overlap the planks.

34. The bulkhead of claim 30 in which the sheeting further comprises a layer of intermediate boards placed substantially vertically into the earth and between the planks and the barrier boards.

35. The bulkhead of claim 30 in which portions of the edges of the intermediate boards overlap.

36. A borer-resistant waterfront retaining bulkhead without piles, comprising:

(a) a wall of sheeting, comprising:

(i) a plurality of planks placed substantially vertically into the earth so that portions of the plank edges overlap; and (ii) a plurality of borer resistant barrier boards placed substantially vertically into the earth and substantially parallel to the planks so that portions of the barrier board edges overlap to form the seaward side of the sheeting;

(b) only one inner upper wale placed adjacent to the sheeting and extending substantially horizontally along the landward side of the sheeting;

(c) only one seaward upper wale placed adjacent to the sheeting and extending substantially parallel to and at substantially the same height as the inner upper wale;

(d) only one seaward lower wale placed adjacent to the sheeting and extending substantially parallel to the seaward upper wale;

(e) at least one anchor placed on the landward side of the sheeting;

(f) at least one tension member connecting the anchor and the seaward lower wale; and thus forming a bulkhead adapted for enhanced resistance to marine borers by virtue of the seaward side of the sheeting being of boards that are resistant to marine borers.

37. The bulkhead of claim 36 in which the barrier boards are formed of material selected from the group consisting of sapwood, treated sapwood, treated plywood and plastic.

38. The bulkhead of claim 36 in which at least one wale is formed of laminated treated sapwood.

39. The bulkhead of claim 36 in which the barrier boards overlap the planks.

40. The bulkhead of claim 36 in which the sheeting further comprises a layer of intermediate boards placed substantially vertically into the earth and between the planks and the barrier boards.

41. The bulkhead of claim 40 in which portions of the edges of the intermediate boards overlap.

* * * * *

UNITED STATES PATENT AND TRADEMARK OFFICE

CERTIFICATE OF CORRECTION

PATENT NO. : 5,244,316

DATED : September 14, 1993

INVENTOR(S) : William M. Wright and Donald E. Andrews

It is certified that error appears in the above-indentified patent and that said Letters Patent is hereby corrected as shown below:

Column 3, line 57, delete the number "2" and insert --22-- therefor

Column 6, line 19, delete the words "t he" and insert --the-- therefor

Column 7, line 60, after the word "wale;" insert --and--

Column 8, line 68, delete the word "carrier" and insert --barrier-- therefor

Column 9, actual line 42 (by counting, as opposed to printed line number), delete the semicolon after the word "substantially"

Column 9, actual line 49 (by counting, as opposed to printed line number), delete the word "to" and insert --for-- therefor Signed and Sealed this Second Day of August, 1994

Bruce Lehman

*Attest:*

BRUCE LEHMAN

*Attesting Officer*

*Commissioner of Patents and Trademarks*